US006216897B1

(12) United States Patent
Wagner

(10) Patent No.: US 6,216,897 B1
(45) Date of Patent: Apr. 17, 2001

(54) FLANGE SCREW CLOSURE AND BOTTLE WITH INSERT HAVING THREADS

(76) Inventor: David C. Wagner, P.O. Box 58, Greenvale, NY (US) 11548-0058

( * ) Notice: Subject to any disclaimer, the term of this patent is extended or adjusted under 35 U.S.C. 154(b) by 0 days.

(21) Appl. No.: 09/320,898

(22) Filed: May 27, 1999

Related U.S. Application Data

(63) Continuation-in-part of application No. 08/846,483, filed on Apr. 30, 1997, now Pat. No. 5,947,310.

(51) Int. Cl.[7] ..... B65D 39/08

(52) U.S. Cl. ..... 215/44; 215/45; 215/329; 215/356

(58) Field of Search ..... 215/40–46, 295, 215/296, 303, 329, 335, 346, 354, 356

(56) References Cited

U.S. PATENT DOCUMENTS

| | | | | |
|---|---|---|---|---|
| 130,208 | * | 8/1872 | Frank | 215/356 |
| 693,161 | * | 2/1902 | Schies | 215/356 |
| 694,013 | * | 2/1902 | Hayes | 215/356 |
| 802,382 | * | 10/1905 | Fenn | 215/356 |
| 2,609,955 | * | 9/1952 | Moore | 215/356 |
| 2,727,787 | * | 12/1955 | Mauzy | 215/356 |
| 3,089,603 | * | 5/1963 | Leslie-Smith | 215/356 |
| 3,141,586 | * | 7/1964 | Wetterek | 215/356 |
| 3,245,569 | * | 4/1966 | Essich | 215/356 |
| 4,671,421 | * | 6/1987 | Reiber et al. | 215/335 X |
| 5,431,306 | * | 7/1995 | Reid | 215/356 |

FOREIGN PATENT DOCUMENTS

| | | | | |
|---|---|---|---|---|
| 648553 | * | 11/1991 | (AU) | 215/335 |
| 921134 | * | 12/1954 | (DE) | 215/354 |
| 859828 | * | 1/1961 | (GB) | 215/354 |

* cited by examiner

*Primary Examiner*—Nathan J. Newhouse
(74) *Attorney, Agent, or Firm*—Sofer & Haroun, LLP

(57) ABSTRACT

An apparatus for retrofitting the opening of the neck of a bottle with a screw closure. An insert is provided that is configured to be positioned within the neck of the bottle for receiving the external threads of the lower end of a screw closure which is inserted into the opening of the bottle and rotated for securement therein. In one embodiment the insert may be secured in the neck by an adhesive. The positioning of the threads in the lower portion of the neck of the bottle affords a smooth and consistent pour of the wine from the bottle.

7 Claims, 4 Drawing Sheets

FLANGE SCREW CLOSURE AND BOTTLE WITH INSERT HAVING THREADS

CONTINUATION DATA

This application is a continuation-in-part of U.S. Patent application Ser. No. 08/846,483, filed Apr. 30, 1997, now U.S. Pat. No. 5,947,310.

FIELD OF THE INVENTION

This invention relates to bottles for liquids and beverages, and in particular, to a wine bottle and complementary flange screw top for improved closure, containment and pouring of wine contained therewithin.

BACKGROUND OF THE INVENTION

Since biblical times, wine has been produced, consumed and enjoyed by people all over the world. Wine is produced from one or more varieties of grapes which grow in well-known regions all over the world. During wine production, the grapes are crushed and the juice is usually stored for a period of time, sometimes many years, during which the wine ferments and the flavor, color, texture and aroma develop. After a period of time, the wine may be ready for bottling, sale and consumption.

For many centuries, wine has been stored and contained in glass bottles of various sizes and sealed with a variety of closure means such as rubber stoppers or cork. Oftentimes, wine bottles are extremely elaborate, thus adding to the attraction of the wine.

To retain the freshness, flavor and aroma of the wine, it is essential that the bottle be tightly sealed to prevent oxygen from seeping in. Most wines produced today are sealed with a cork closure and are often covered with a decorative foil capsule. Corks, however, often allow oxidation to take place, as they are easily broken or crumbled. As a result of a defective cork, oxidation results in "corkiness" which is characterized by a pungent smell, much like that which emanates from rotting newspapers, and which damages the wine rendering it unfit for sale or consumption. Additionally, oxidation resulting from defective corks affect 5% of all cork-finished wines, amounting to millions of defective bottles a year which costs the industry and consumers million of dollars a year in unsaleable and inconsumable goods. Furthermore, if a wine which was sealed with a cork is not consumed within a relatively short period of time after the cork has been removed, it tends to become flat and loses its taste.

Aluminum or plastic screw caps which are matingly threaded to external threads on the neck of the bottle and which are similar to those used on soda bottles, have been found to be the best closure for wine bottles, having a nearly perfect record of maintaining the quality of wine inside the bottle and eliminating any chance of oxygen seeping in. In fact, many lower quality, inexpensive wines currently use screw caps. As a result, the screw cap has become synonymous with cheap wine and, despite their superior closure capabilities, have been shunned by today's producers of the better wines who, in an effort to provide more attractive bottling, have widened the opening of the wine bottles, eliminated the foil capsule and sealed the top of the cork with a drop of bee's wax. It provides for an attractive bottle, but does not eliminate the problem of defective corks.

The prior art includes internally threaded bottles or receptacles, such as U.S. Pat. No. 1,415,908 for a jar closure, U.S. Pat. No. 2,026,304 directed to a container and closure therefor, and U.S. Pat. No. 2,820,671 which teaches a method of distributing soil treating material. However, none of these references are directed to bottles or containers for holding wine. Additionally, each of these prior art references teach internal threads disposed in the neck portion of the bottle or container proximate the opening. These prior art container with internal threads positioned proximate the opening of the bottle discourage their use for containing wine since the internal threads positioned proximate the bottle's opening detracts from the bottle's ability to provide a smooth and consistent pour of wine. If used for containing wine, these prior art bottles lead to a waste of the wine as the internally disposed threads proximate the opening causes the wine to haphazardly splash out of the bottle as it is being poured therefrom.

Accordingly, there is a need for a glass bottle for containing wines and which is configured to accommodate a screw top, the combination of the bottle and screw top which is attractive, which assures a smooth consistent pour, and which ensures the quality of wine contained within the bottle.

OBJECTS AND SUMMARY OF THE INVENTION

It is thus a general object of the present invention to provide a bottle for containing wines which provides a reliable closure.

A more specific object of the present invention is to provide a wine bottle having an internally threaded neck portion for mating with a complementary single unit screw top with a flange rim.

It is an additional object of the present invention to provide a wine bottle having an internally threaded neck portion wherein the internal threads are disposed low in the neck portion away from the bottle opening so as to provide a smooth and consistent pour of wine from the bottle.

It is another object of the present invention to provide a glass bottle having an internally threaded neck portion for engagement with a single unit screw top with a flange rim and which is aesthetically appealing without the obtrusive, denigrating externally exposed threads associated with existing standard plastic or aluminum screw tops.

It is further object of the present invention to provide a bottle and closure which permits efficient re-sealing of the bottle after the initial opening such that the quality of wine contained with in the bottle is retained.

It is still an additional object to provide a bottle and closure for efficiently storing and resealing a bottle containing wine and which is simple in construction, inexpensive to manufacture and efficient to use.

These and other objects of the invention are realized by providing a bottle much like the conventional wine bottles presently available in the marketplace. The bottle is generally provided with a flat lower portion which extends upwardly and narrows into a neck portion which terminates in the bottle opening. The neck portion is provided with internal threads for mating engagement with a screw closure. The internal threads are advantageously disposed low in the neck portion of the bottle so as to provide a smooth, uninterrupted flow of wine from the bottle. Additionally, the low placement of the internal threads prevents waste of the wine which often accumulates within the threads on externally threaded bottles.

The screw closure for securement within the bottle of the present invention is provided with an upper end having a flange rim and an extended body having threads on its lower end. When the screw top is inserted into the opening and neck of the bottle, the threads on the lower end of the screw mate with the internal threads of the bottle. The screw top is thus secured within the bottle by rotating the flange rim until the screw top is tightly secured. When tightly secured, the flange rim of the screw top mates with the opening of the bottle such that bottle is aesthetically appealing without denigrating exposed external threads.

In an alternative embodiment, the screw top may also be provided with a tamper resistant safety feature. Furthermore, an insert including the screw top of the present invention may also be provided for retrofitting current wine bottles produced without internal threads.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views.

Figure 3:
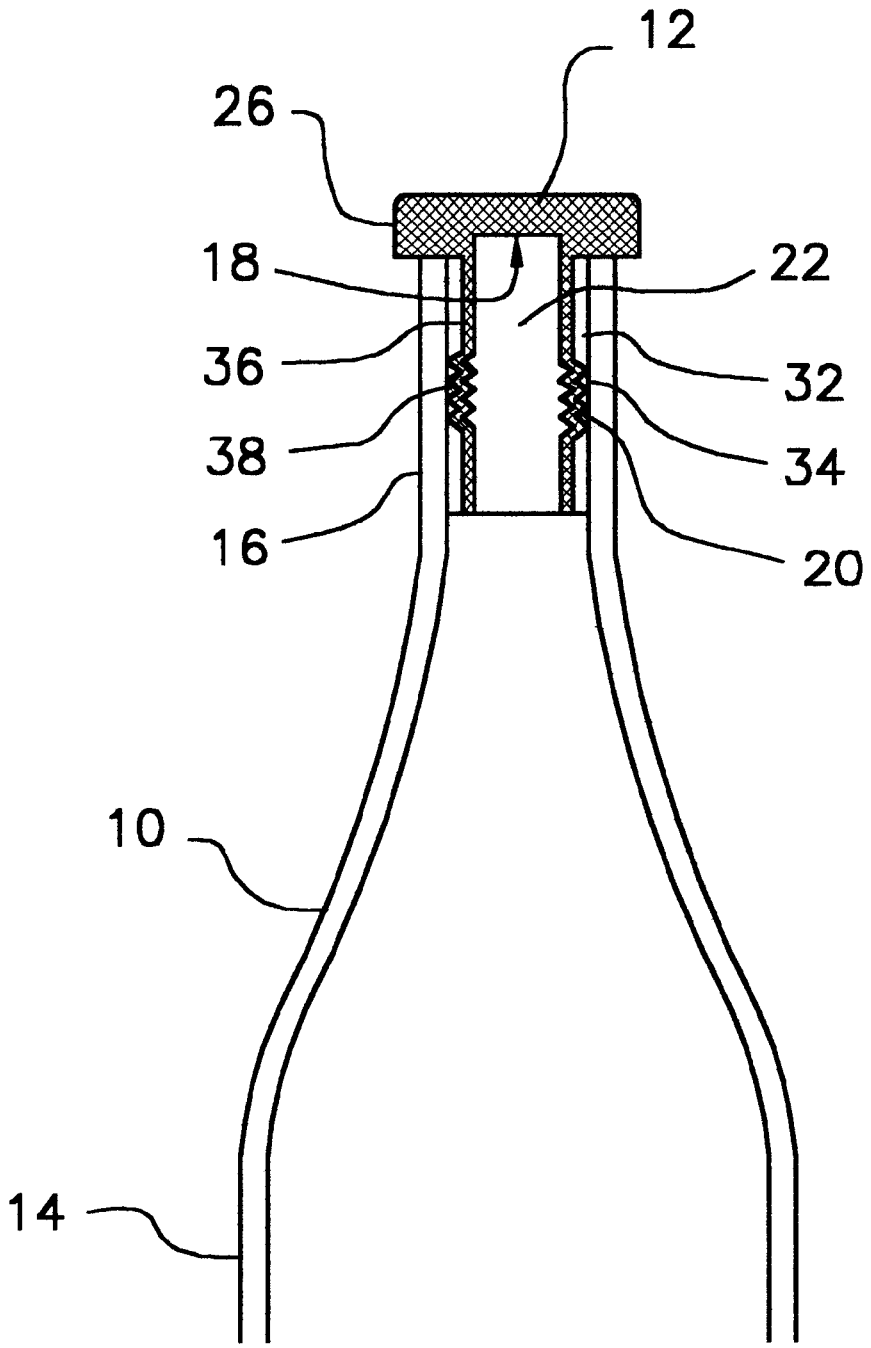
Figure 4:
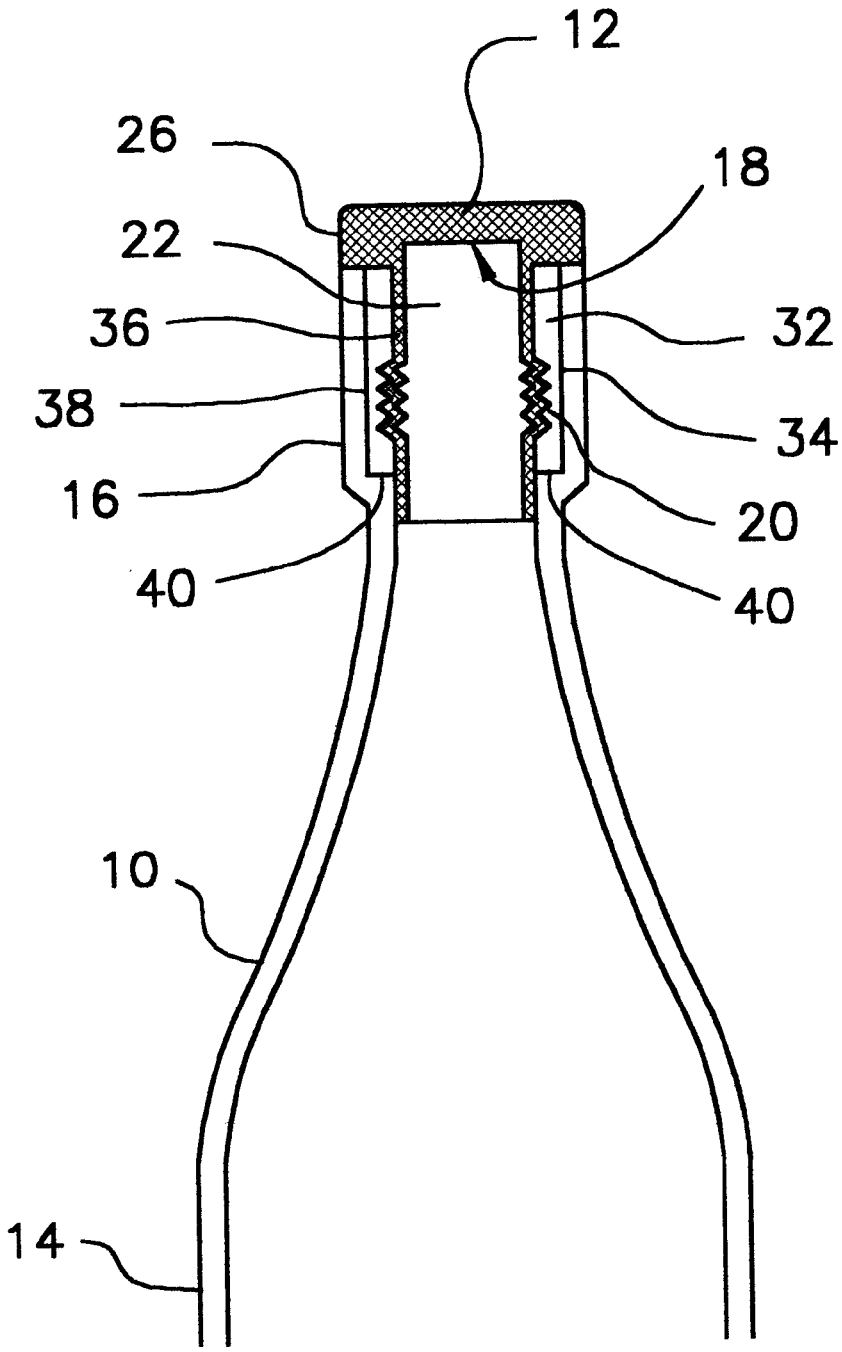

FIG. 3 illustrates sectional view of an alternative embodiment of the present invention which includes a plastic insert for retrofitting existing bottles with internal threads for use with the flange-rimmed screw top; and FIG. 4 illustrates a sectional view of an alternative embodiment of the bottle shown in FIG. 3 for receiving a plastic insert for retrofitting existing bottles with internal threads for use with the flange-rimmed screw top.

DETAILED DESCRIPTION OF THE PRESENTLY PREFERRED EMBODIMENT

Figure 1:
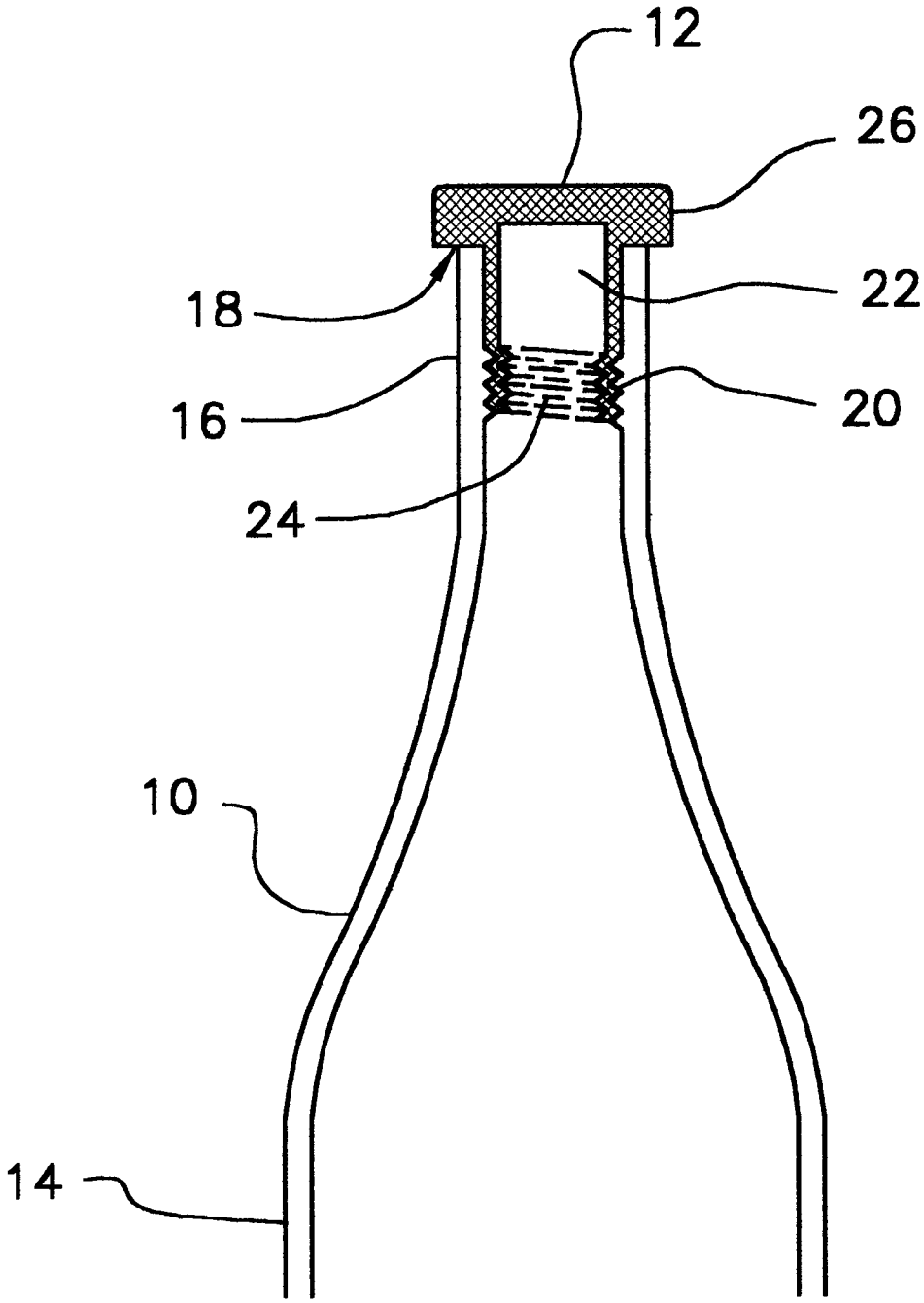
FIG. 1 illustrates a sectional view of the neck portion of a wine bottle in accordance with one embodiment of the present invention and including the flange-rimmed screw top internally threaded therein.

With initial reference to FIG. 1, a bottle 10 with a complementary screw closure 12 secured thereto is shown according to one embodiment of the present invention. Bottle 10 is preferably formed from cast glass using a mold, and includes a body portion 14 and a neck portion 16 which terminates in opening 18.

Bottle 10 is provided with internal spiral threads 20 disposed peripherally within neck portion 16. Internal threads 20, which commonly comprise alternating ribs and grooves for receiving complementary threads of some other member or part, are advantageously positioned low within neck portion 16 downward and away from opening 18, and spaced approximately in the range of 1 to 1¾ inches from opening 18. It is understood, however, that internal threads 20 may also be disposed at greater or lesser distances from opening 18. The positioning of internal threads 20 away from opening 18 affords a smooth, uninterrupted flow of wine from the bottle. Additionally, the low placement of the internal threads 20 in neck portion 16 prevents waste of the wine which often accumulates in bottles having external threads.

Screw closure 12 is advantageously fabricated from a molded plastic and includes an elongated body 22 for fitting within neck portion 16 of bottle 10. Body 22 is provided with peripheral external screw threads 24 on one end and a flange-rimmed top 26 on the opposite end. To correspond with internal threads 20 of neck portion 16 of bottle 10, external screw threads 24 on screw closure 12 are advantageously disposed approximately in the range of 1 to 1¾ inches from the flange-rimmed top. It is understood, however, that external screw threads 24 of screw closure 12 may also be disposed at greater or lesser distances from flange-rimmed top 26, so long as they are disposed on screw closure 12 so as to correspond with internal threads 20 of neck portion 16 of bottle 10 when screw closure 12 is inserted into opening 18 of bottle 10.

To seal bottle 10 using screw closure 12, screw threads 24 are directed first into opening 18 of neck portion 16 and pressure is directed to flange rimmed top 26 until screw threads 24 engage internal threads 20 in neck portion 16 of bottle 10. Upon engagement of screw threads 24 with internal threads 20, flange-rimmed top 26 of screw closure 12 is rotated until screw closure 12 is tightly secured in neck portion 16. When fully inserted and secured within neck portion 16 of bottle 10, body 22 of screw closure 12 engages the interior of neck portion 16 to create an air tight seal. Furthermore, when screw closure 12 is fully inserted and secured within neck portion 16, flange rimmed top 26 of screw closure 12 is matingly engaged with opening 18 of neck portion 16 to enhance the air-tight seal provided by the screw closure 12 positioned within neck portion 16.

When the wine is ready to be opened, flange-rimmed top 26 of screw closure 12 is simply twisted off and lifted out from neck portion 16. If the entire bottle of wine is not consumed, the bottle may be easily re-sealed by reinserting and securing screw closure 12 in neck portion 16 by turning flange-rimmed top 12 until screw closure 12 is tightly secured therein.

Figure 2:
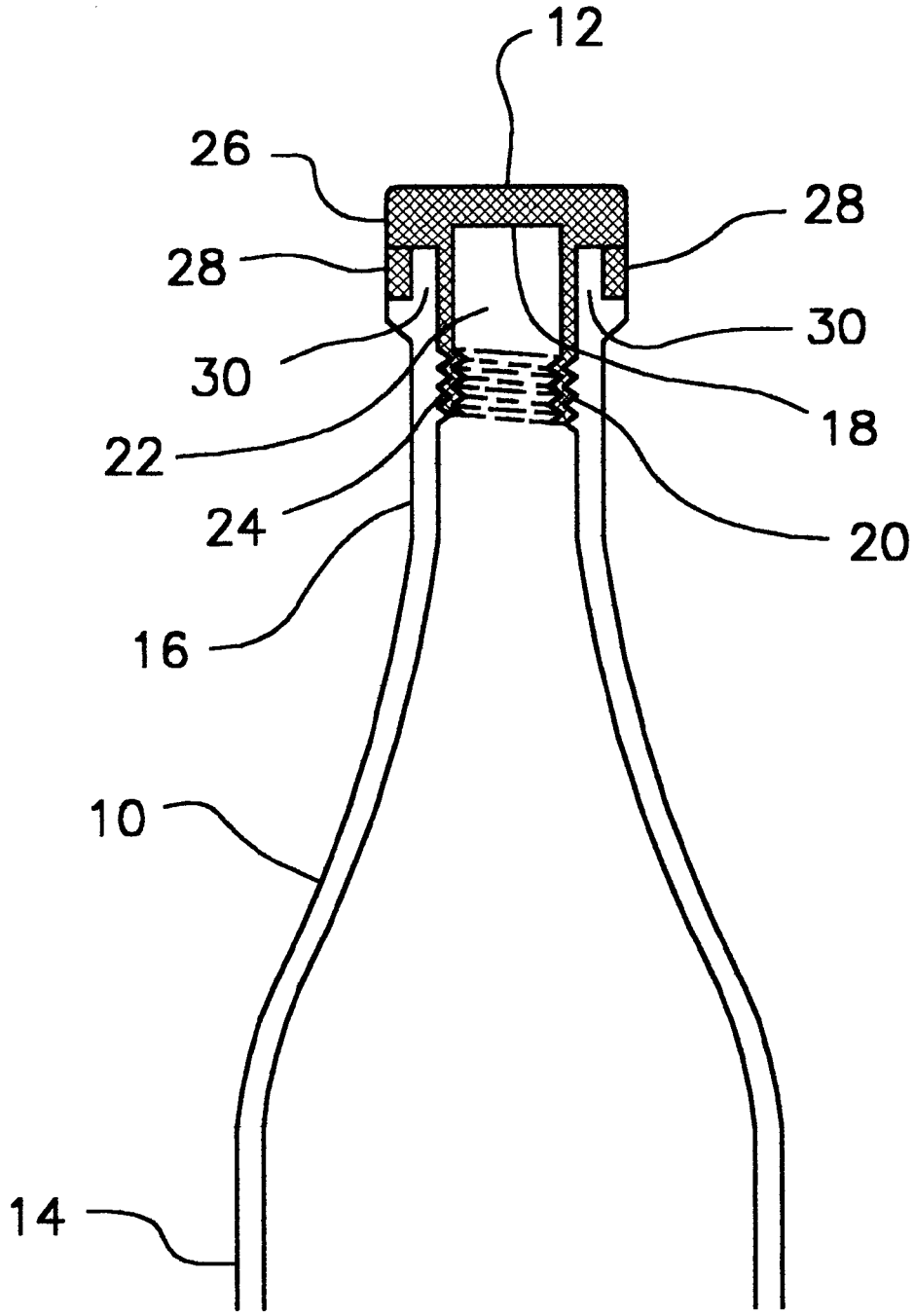
FIG. 2 illustrates a sectional view of the neck portion of the wine bottle of FIG. 1 and including a flange-rimmed screw top internally threaded therein and having a tamper resistant safety feature.

In an alternative embodiment as illustrated in FIG. 2, bottle 10 is configured to receive screw closure 12 configured with a tamper resistant safety feature to prevent opening of the wine bottle by children. To provide a tamper resistant closure, screw closure 12 advantageously includes a flexible plastic ring 28 integral with flange-rimmed top 26. Ring 28, is generally provided with a plurality of ridges (not shown) disposed about the circumference of ring 28 and which engage a plurality of complementary cavities 30 formed within neck portion 16 proximate opening 18. When screw closure 12 is secured within neck portion 16 and flange-rimmed top is matingly engaged with opening 18, the ridges of ring 28 protrude into cavities 30 such that screw closure 12 is not easily removed from bottle 10. In order to remove screw closure 12, ring 28 must be squeezed with sufficient force, not generally attainable by children, which frees the ridges of ring 28 from their position within cavities 30 in neck portion 16 such that screw closure 12 may then be easily removed. It is to be understood, that the invention is not limited in the configuration and locking mechanism of the tamper resistant feature of screw closure 12 and other tamper resistant features may be utilized without detracting from the inventive aspects of the present invention. As with the first embodiment, neck portion 16 of bottle 10 is advantageously provided with internal threads disposed approximately in the range of 1 to 1¾ inches from opening 18 of bottle 10, for threadable engagement with screw threads 24 when screw closure 12 is secured within opening 18 and neck portion 16 of bottle 10.

FIG. 3 illustrates another alternative embodiment of the present invention for use with existing cork-sealed bottles. Upon opening the bottle of wine and removing the cork (not shown), a plastic insert 32 is inserted into opening 18 of bottle 10 and positioned within neck portion 16. Insert 32 has a smooth exterior wall 34 which engages the interior surface of neck portion 16 and created an air-tight seal therewith. As illustrated in FIG. 4, the interior of neck portion 16 of bottle 10 may also be provided with support walls 40 to regulate the distance of which insert 32 is positioned within neck portion 16 and to prevent insert 32 from extending past neck portion 16 and falling into the wine contained in bottle 10.

With further reference to FIGS. 3 and 4, interior wall 36 of insert 32 is provided with internal threads 38 similar to the internal threads 20 in neck portion of bottle 10 as discussed with reference to the first embodiment in FIG. 1. Insert internal threads 38 are advantageously positioned approximately in the range of 1 to 1¾ inches from opening 18 of bottle 10 and are configured to receive and secure a screw closure 12, the structure which has been described hereinabove with reference to the first embodiment in FIG. 1. As with the first embodiment, engagement of body portion 22 of screw closure 12 with interior wall 36 of insert 32 provides an air and fluid tight seal when screw threads 20 of screw closure 12 are mated with insert internal threads 38 as a result of the turning of flange-rimmed top 26 of screw closure 12.

Insert 32 may be removable from bottle 10 for repeated use or may be disposable Additionally, insert 32 may also be provided with an adhesive on exterior wall 34 to enhance its seal with the interior surface of neck portion 16. Screw closure 12 may be produced for sale and packaged together with insert 32 or sold alone.

It is understood that while bottle 10 is advantageously formed from cast glass, the invention is not limited in this respect and bottle 10 may be fabricated from other types of materials and provided with internal threads 20 within neck portion 16 for threadably engaging screw closure 12. Additionally, screw closure 12 is not limited to fabrication of molded plastic and may be formed from other materials such as metal or hard rubber.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto.

It is to be understood that the drawings are not necessarily drawn to scale, but that they are merely conceptual in nature.

What is claimed is:

1. A combination glass bottle and apparatus for retrofitting the opening of the neck of said bottle with a screw closure comprising:

a glass bottle having a neck which terminates in an opening, said neck having an upper portion proximate said opening and a lower portion, said lower portion including internal support walls;

an insert configured for introduction into said opening of said glass bottle and for positioning within said neck of said glass bottle, said insert having an internal surface provided with internally disposed treads spaced from said opening for providing a smooth and consistent pour of liquid from said glass bottle, wherein said support walls are provided to regulate the position of said insert which is positioned within said neck portion so that said insert rests upon said support walls when inserted into said opening of said glass bottle; and a screw closure constructed of either molded plastic, metal or hard rubber having an upper end, a lower end and a body portion extending between said upper and lower ends, said lower end provided with external threads for engaging said internally disposed threads of said insert when said screw closure is directed into said insert, wherein said internally disposed threads in said insert are spaced in the range of approximately 1 to 1¾ inches from said opening of said glass bottle such that when said screw closure is threadably engaged with said insert an airtight seal is formed.

2. The apparatus as recited in claim 1, wherein said support walls are integrally molded as part of said bottle.

3. The apparatus as recited in claim 1, wherein said screw closure further comprises a flange portion that is configured to sit atop said neck portion of said bottle.

4. The apparatus as recited in claim 1, wherein said insert further comprises a smooth exterior surface which creates a fluid tight seal with said neck portion of said bottle when said insert is positioned in said neck portion.

5. The apparatus as recited in claim 4, wherein said smooth exterior surface of said insert is configured to frictionally engage said neck portion of said bottle.

6. The apparatus as recited in claim 4, wherein said smooth exterior surface of said insert is provided with an adhesive for enhancing said fluid tight seal created between said smooth exterior surface and said neck portion of said bottle.

7. The apparatus as recited in claim 6, wherein said adhesive is a quick-drying food-grade cement.

* * * * *